US011976870B2

(12) United States Patent
Yee et al.

(10) Patent No.: US 11,976,870 B2
(45) Date of Patent: May 7, 2024

(54) MODULAR CONTAINER FOR GROCERIES OR OTHER PRODUCTS

(71) Applicant: Robert Bosch GmbH, Stuttgart (DE)

(72) Inventors: Seow Yuen Yee, Mountain View, CA (US); Philip Roan, San Mateo, CA (US)

(73) Assignee: Robert Bosch GmbH (DE)

( * ) Notice: Subject to any disclaimer, the term of this patent is extended or adjusted under 35 U.S.C. 154(b) by 356 days.

(21) Appl. No.: 16/234,814

(22) Filed: Dec. 28, 2018

(65) Prior Publication Data

US 2020/0208896 A1 Jul. 2, 2020

(51) Int. Cl.

| | |
|---|---|
| ***F25D 11/00*** | (2006.01) |
| ***F25D 19/04*** | (2006.01) |
| ***F25D 25/00*** | (2006.01) |

(52) U.S. Cl.

CPC ..... *F25D 11/003* (2013.01); *F25D 19/04* (2013.01); *F25D 25/005* (2013.01); *F25D 2400/12* (2013.01); *F25D 2400/14* (2013.01); *F25D 2400/38* (2013.01)

(58) Field of Classification Search

CPC .. F25D 11/003; F25D 19/003; F25D 2400/38; F25D 11/006; F25D 11/00; F25D 19/04; F25D 25/005; F25D 2400/12; F25D 2400/14; F25D 25/025

See application file for complete search history.

(56) References Cited

U.S. PATENT DOCUMENTS

| | | | | |
|---|---|---|---|---|
| 3,733,836 | A * | 5/1973 | Corini | F25D 17/06 62/3.61 |
| 7,197,888 | B2 | 4/2007 | LeClear et al. | |
| 10,126,040 | B1 | 11/2018 | Ribeiro et al. | |
| 10,408,522 | B2 | 9/2019 | Tsui | |
| 2008/0156033 | A1 | 7/2008 | Cur et al. | |
| 2011/0220531 | A1 | 9/2011 | Meether et al. | |
| 2014/0166673 | A1* | 6/2014 | Butler | F25D 11/003 220/592.02 |

(Continued)

FOREIGN PATENT DOCUMENTS

| | | |
|---|---|---|
| CN | 1683894 A | 10/2005 |
| CN | 201152663 Y | 11/2008 |

(Continued)

OTHER PUBLICATIONS

Translation of CN Search Report for CN 201911376575.2, Dated Jan. 6, 2023, 7 Pages.

*Primary Examiner* — Frantz F Jules
*Assistant Examiner* — Martha Tadesse
(74) *Attorney, Agent, or Firm* — Dickinson Wright PLLC

(57) ABSTRACT

A modular container such as a mobile refrigerator is configured to attach to a larger in-home refrigerator. The modular container has an attachment feature configured to selectively attach and detach from a first attachment feature of the larger refrigerator to enable the modular container to be selectively attached and detached from the interior compartment of the larger refrigerator. A door of the modular container is configured to selectively enclose an interior of the modular container. The modular container has its own dedicated refrigeration system mounted thereon, enabling the modular container to act as its own refrigerator once removed from the larger refrigerator.

13 Claims, 4 Drawing Sheets

(56) References Cited

U.S. PATENT DOCUMENTS

| | | | | |
|---|---|---|---|---|
| 2015/0153217 | A1 | 6/2015 | Dillon et al. | |
| 2016/0162715 | A1 | 6/2016 | Luk et al. | |
| 2016/0220072 | A1 | 8/2016 | Bagley | |
| 2016/0265837 | A1 | 9/2016 | Bhatt et al. | |
| 2017/0261237 | A1* | 9/2017 | High | F25B 9/04 |
| 2018/0142943 | A1 | 5/2018 | Haney et al. | |
| 2020/0363126 | A1 | 11/2020 | Chae et al. | |

FOREIGN PATENT DOCUMENTS

| | | | | | |
|---|---|---|---|---|---|
| CN | 102164829 | A | | 8/2011 | |
| CN | 203893528 | U | | 10/2014 | |
| CN | 204115365 | U | | 1/2015 | |
| CN | 104350527 | A | | 2/2015 | |
| CN | 204555485 | U | | 8/2015 | |
| CN | 106766645 | A | | 5/2017 | |
| CN | 107024072 | A | | 8/2017 | |
| JP | 07151439 | A | * | 6/1995 | F25D 11/006 |
| JP | H07151439 | A | | 6/1995 | |
| JP | 2001201234 | A | | 7/2001 | |
| JP | 2002228349 | A | | 8/2002 | |
| JP | 2006145153 | A | | 6/2006 | |
| JP | 2006336969 | A | | 12/2006 | |
| KR | 19990032728 | U | | 7/1999 | |
| KR | 20100085230 | A | | 7/2010 | |
| KR | 20150070737 | A | | 6/2015 | |
| KR | 20150075634 | A | | 7/2015 | |
| WO | 2011003754 | A2 | | 1/2011 | |

* cited by examiner

MODULAR CONTAINER FOR GROCERIES OR OTHER PRODUCTS

TECHNICAL FIELD

The present disclosure relates to a modular container for carrying groceries. In certain embodiments, a modular container is specifically configured to be attached to a larger structure such as a refrigerator, enabling a consumer to load the modular container with products such as groceries and assemble the loaded modular container to the larger structure without taking the products out of the modular container.

BACKGROUND

It is known in the art of refrigerated appliances to have storage bins. The bins allow a consumer to separate different types for food or produce. For example, a first bin can be designated for vegetables, another bin can be designated for fruits, and so on. The storage bins can slide in and out of the refrigerator to allow the consumer to slide the bin out, put produce in or take produce out, and then slide the bin back into the refrigerator.

SUMMARY

In one embodiment, a refrigerator includes an interior compartment having a first attachment feature. A modular container has a second attachment feature configured to selectively attach and detach from the first attachment feature to enable the modular container to be selectively attached and detached from the interior compartment. A door of the modular container is configured to selectively enclose an interior of the modular container. The modular container has its own dedicated refrigeration system mounted thereon.

In another embodiment, a mobile refrigerator is configured to be assembled to a larger refrigerator. The mobile refrigerator includes a rear wall, a pair of side walls, and a front door wall defining an interior compartment, wherein the front door wall is pivotable to selectively provide access or seal the interior compartment. A guide or rail on at least one of the walls is configured to engage with a corresponding guide or rail in the larger refrigerator to enable the mobile refrigerator to slide in and out of the larger refrigerator. A refrigeration system is configured to cool the interior compartment. A battery is coupled to the refrigeration system to selectively power the refrigeration system.

In another embodiment, a system is provided for storing groceries within a modular container that is connectable to both a refrigerator and a pantry. A refrigerator has an interior compartment including a first rail or guide. A modular container has a second rail or guide configured to (i) engage with the first guide or rail in the refrigerator to enable the modular container to selectively attach within the interior compartment to store refrigerated groceries, and (ii) engage with a third guide or rail in a pantry to enable the modular container to selectively attach within the pantry to store non-refrigerated groceries.

DETAILED DESCRIPTION

Figure 1:
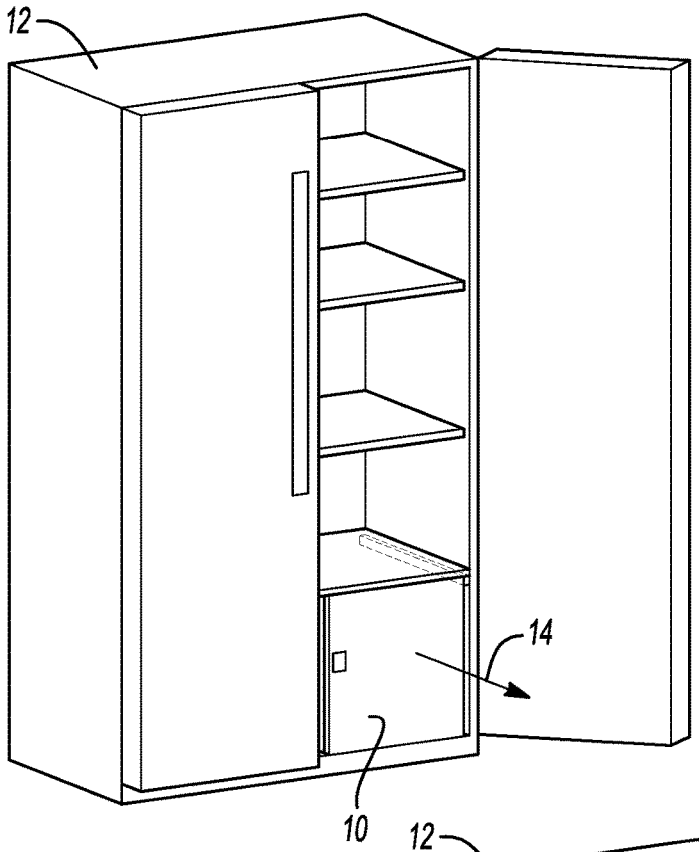
FIG. 1 is a perspective view of a modular container stored within a larger refrigerator, according to one embodiment.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Grocery shopping can be cumbersome. A typical grocery-shopping experience can include: entering a grocery store, filling a grocery cart with food and drinks, waiting in a check-out line, emptying the food and drinks onto a conveyer belt so that the cashier can scan the food and drinks, filling the food and drinks into paper or plastic grocery bags, placing the bags into the shopping cart, bringing the shopping cart to a vehicle, unloading the filled grocery bags into the vehicle, driving home, unloading the grocery bags out of the vehicle, bringing the grocery bags into the house, and individually unloading the food and drinks from the grocery bags into a refrigerator, freezer, pantry, etc. This process is inefficient, requiring a large amount of effort to move the food and drinks multiple times, all while the temperature of the food and drinks could increase/decrease to an undesirable level. The grocery experience is ripe for increased efficiency.

According to various embodiments disclosed herein, a modular container for groceries (e.g., food, drinks, produce) is provided. The modular container can be easily attached to and removed from an in-home refrigerator and/or pantry. The modular container can have its own refrigeration/heating unit, allowing the modular container to actively cool/heat the groceries contained therein. A consumer can detach the modular container from the in-home refrigerator, bring the modular container to the grocery store, fill up the modular container with groceries, bring the filled modular container home and slide the modular container into place within the in-home refrigerator. A consumer can also have an additional collapsed modular container which is stored when not in used and can be used for grocery shopping. Once home, consumer can swap out the existing container from the fridge or attached it to a different attachment within the fridge. One or more modular containers can fit into the larger refrigerator. The modular container removes several steps of loading and unloading groceries by allowing the entire modular container with several groceries contained therein to be attached in place within the refrigerator or pantry without unloading the groceries individually.

Figure 2:
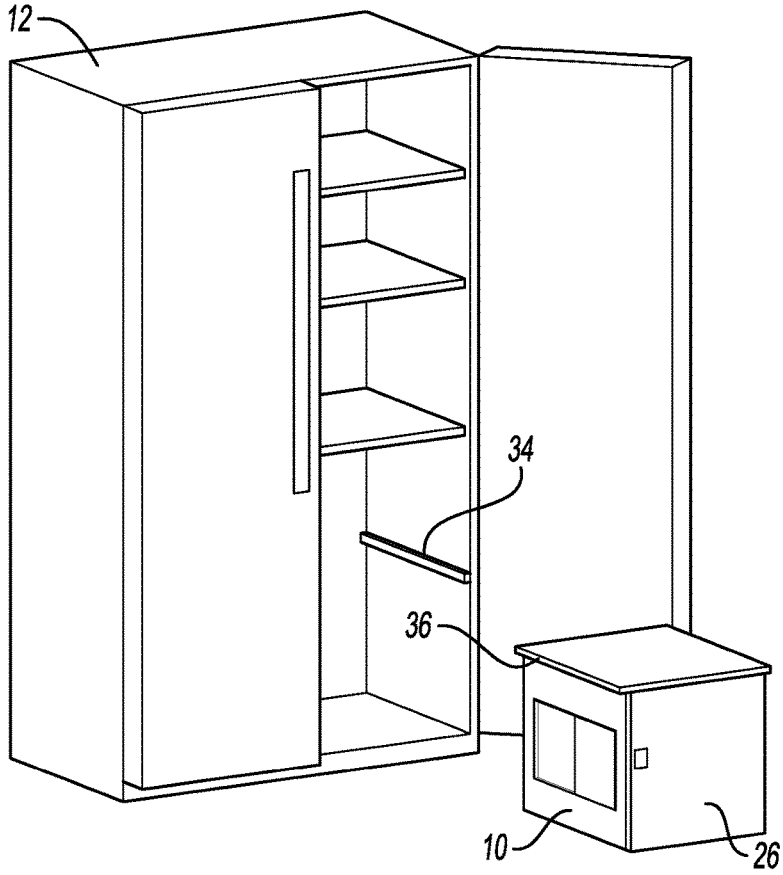
FIG. 2 is a perspective view of the modular container removed from the larger refrigerator, according to one embodiment.

FIG. 1 illustrates a modular container 10 relative to an in-home, larger refrigerator 12. The larger refrigerator 12 can be any similar appliance, such as a freezer, or combined refrigerator and freezer in a single unit. The larger refrigerator 12 can also be any style, such as French door, top freezer, side-by-side, bottom freezer, etc. The modular container 10 can be removed from the larger refrigerator 12, as shown by arrow 14. FIG. 2 shows the modular container 10 fully removed and disconnected from the larger refrigerator 10. The modular container 10 can then be grasped and moved by a consumer, as shown in FIG. 3.

Referring to FIGS. 1-7, in one embodiment, the modular container 10 has a rear wall 20, a first side wall 22, a second side wall 24, a front wall or door 26, and a top wall 28, and a bottom wall 30. The walls and door define an enclosed container or interior that can be ventilated, sealed off and self-refrigerated/heated, as will be described below. The door 26 can pivot or rotate relative to the other walls so as to provide access to the interior of the modular container 10.

The larger refrigerator 12 defines an interior where produce is stored. To accommodate and receive the modular container 10, the larger refrigerator 12 has first connection features 34. Likewise, the modular container 10 has second connection features 36 configured to engage with the first connection features to attach the modular container 10 within the interior of the larger refrigerator 12. In one embodiment, the first connection features 34 are guides or rails extending into the depth of the larger refrigerator 12, and the second connection features 36 are corresponding guides or rails. The second connection feature 36 may be a ledge or shoulder that extends outward away from the plane of the side walls 22, 24. To assemble the modular container 10 to the larger refrigerator, a consumer can rest the second connection feature on or in the first connection feature, and slide the modular container 10 into the refrigerator 12. It may therefore be said that the combination of the first connection feature 34 and the second connection feature 36 enable the modular container 10 to slideably enter and exit the larger refrigerator 12.

Figure 3:
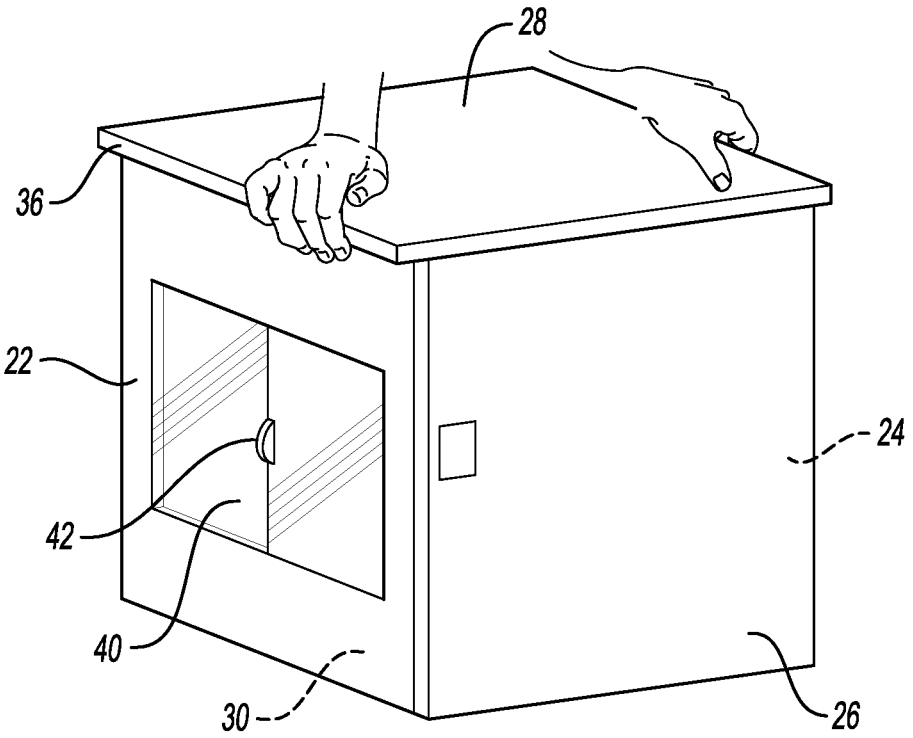
FIG. 3 is a front perspective view of the modular container being grasped by a consumer, according to one embodiment.

The second connection features 36 may also act as handles for the consumer, as shown in FIG. 3. By extending laterally away from the sidewalls of the modular container 10, the second connection features provide a grasping portion for the consumer to grasp on, facilitating removal and insertion of the modular container 10 relative to the larger refrigerator 12.

The modular container 10 may also have one or more windows 40. The windows 40 can slide shut when the modular container 10 is removed from the refrigerator 12 so as to provide a sealed unit. For example, the window 40 may be a split-pane window with one pane slideable relative to the other pane. A knob or handle 42 may extend outwardly therefrom to allow the consumer to open and close one of the panes of the window. In one embodiment, the larger refrigerator 12 has structure that engages with the handle 42 to automatically open the window 40 when the modular container is slid into engagement with the larger refrigerator 12. This opens the interior of the modular container 10 to the environment of the interior of the larger refrigerator 12 such that the larger refrigerator 12 can cool the interior of the modular container 10. Likewise, when the modular container 10 is slid out and removed from the larger refrigerator 12, the structure in the larger refrigerator may engage the handle 42 to automatically close the window 40. This seals the modular container 10 as it is removed from the larger refrigerator 12, allowing the modular container to maintain a desired temperature with a dedicated refrigeration/heating system, for example.

Figure 4:
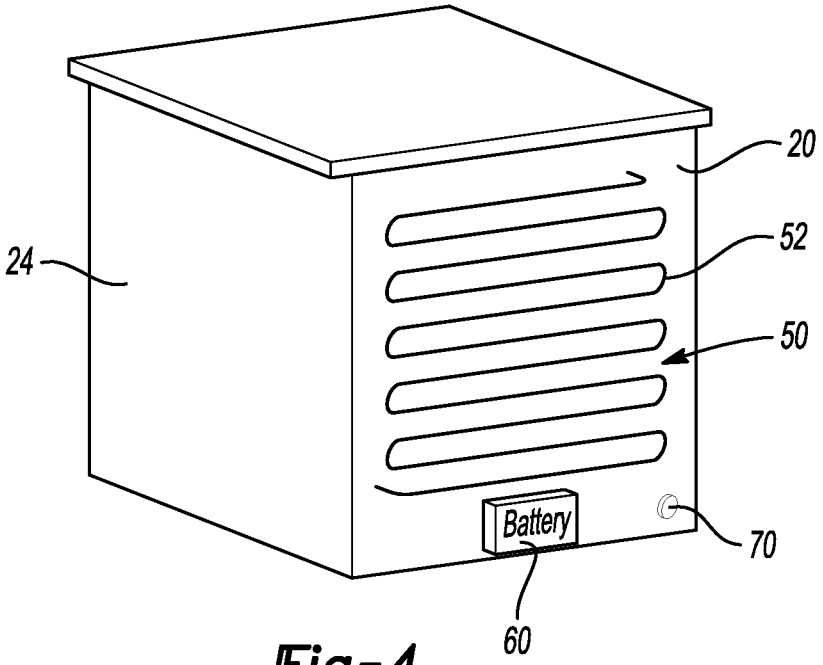
FIG. 4 is a rear perspective view of the modular container, illustrating a dedicated refrigeration system according to one embodiment.

In one embodiment, the modular container 10 has a dedicated refrigeration system, generally shown at 50 in FIG. 4. The refrigeration system may include components that are typical of a small refrigerator—fluid refrigerant, a compressor to control the flow of the refrigerant, condenser coils 52 on the outside of the modular container 10, evaporator coils on the inside of the modular container 10, and an expansion device. One or more components of the refrigeration system 50 may be mounted to the rear wall 20. When removed from the larger refrigerator 12, the modular container can act as a smaller refrigerator, with the refrigeration system 50 keeping the contents of the interior compartment cooled at a desirable temperature. There may be environment sensors such as temperature sensors integrated with the container such that the refrigeration system will only activate when the temperature rises above a certain range. Similarly, the following can also be described for heating system and the heating system will only activate when the temperature falls below a certain range.

Powering the refrigeration system 50 is a rechargeable battery 60. The battery 60 may be any suitable rechargeable battery sufficient to power a small refrigeration system for one or two hours, such as a 20V lithium ion battery for example. The battery 60 may be coupled to the compressor to operate the refrigeration system 50.

A sensor, also referred to as switch 70, may be provided on the modular container 10. The switch 70 may be a contact sensor, light sensor, proximity sensor, etc. The switch 70 is configured to deactivate and activate the battery 60 for either powering the refrigeration system 50 or charging. For example, when the modular container 10 is properly positioned and assembled within the larger refrigerator 12 or pantry, the switch 70 deactivates the battery 60 from powering the refrigeration system 50, and instead allows power from the larger refrigerator 12 to flow into the battery 60 to charge the battery 60. This may be done by closing electrical pathways and opening others. Power inverters and amplifiers may be provided between the larger refrigerator's power supply and the modular container, as necessary. The larger refrigerator 12 may also have a receptacle that receive a portion of the battery 60 to connect the larger refrigerator's power supply to the battery 60 to initiate charging. Wireless charging between the larger refrigerator 12 and the modular container 10 may also be provided. Conversely, when the modular container 10 is removed from the larger refrigerator 12, the battery 60 is removed from the larger refrigerator's power supply and is able to power the dedicated refrigeration system 50 on-board the modular container 10. The switch 70 may allow the transfer of power from the battery 60 to the refrigeration system 50 upon removal of the modular container 10 from the larger refrigerator 12. In other words, when the switch 70 no longer detects that the modular container 10 is assembled to either the larger refrigerator 12 or the pantry, the switch 70 can enable the battery 60 to power the refrigeration system 50 when needed.

Figure 5:
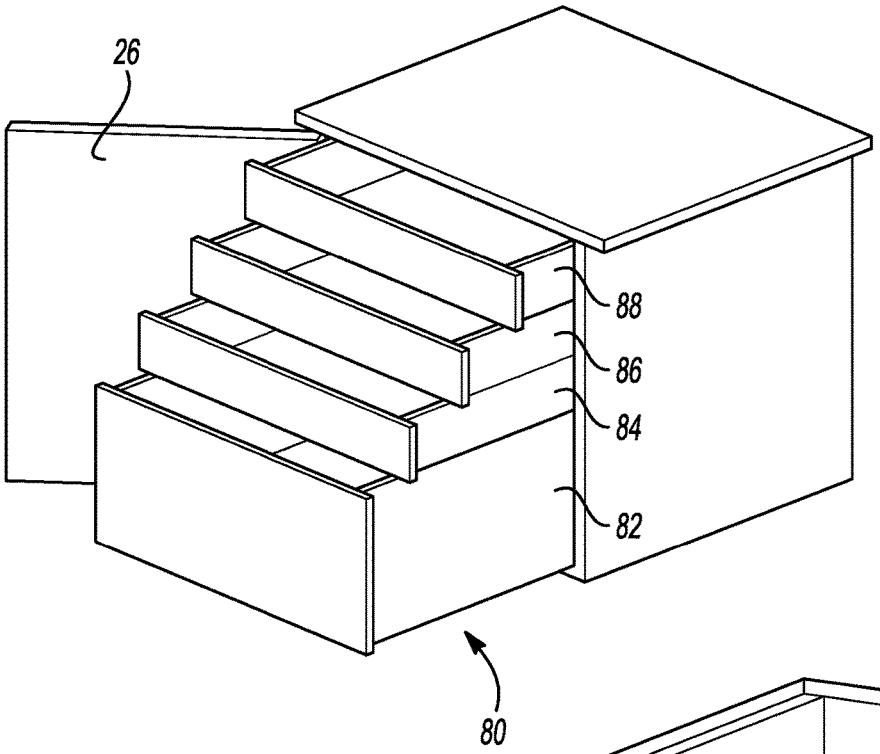
FIG. 5 is a front perspective view of the modular container according to an embodiment in which the interior has separated compartments.

FIG. 5 illustrates an embodiment in which the interior of the modular container 10 is provided with a shelving unit 80 having a plurality of shelves, e.g., shelf 82, shelf 84, shelf 86, and shelf 88. Each shelf can slide in and out of the modular container 10, supported by a respective guide or rail in the interior of the modular container 10. The shelves provide separation within the modular container to separate out, for example, refrigerated groceries from non-refrigerated groceries. Each shelf 82-88 can also be configured to be attached within the larger refrigerator 12. For example, shelf 82 may be identically sized as a "crisper" tray (e.g., vegetable tray, etc.) within the larger refrigerator 12. The consumer may remove shelf 82 from the modular container 10, and attach the shelf 82 to the larger refrigerator 12 in the same manner as the consumer would attach the "crisper" tray. In one embodiment, the refrigeration system 50 works to actively cool the air of only some the interior of the modular container 10, e.g., the air within shelf 80.

Figure 6:
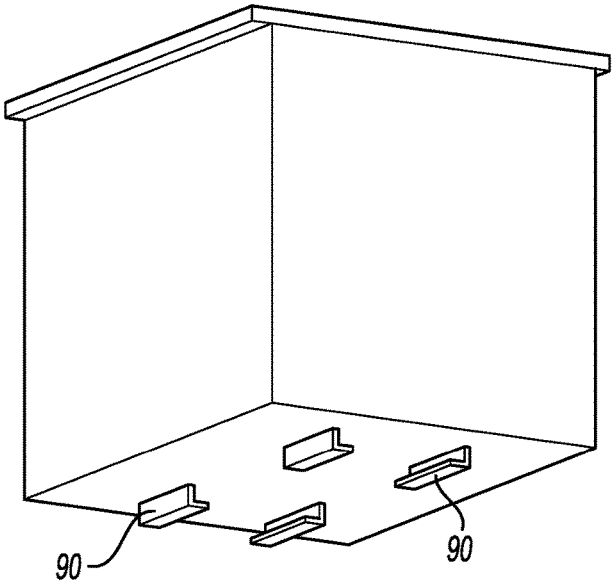
FIG. 6 is a bottom perspective view of the modular container according to an embodiment.

FIG. 6 illustrates one embodiment in which the modular container 10 has attachment features 90 configured to attach to a moveable frame, such as a dolly with wheels. In the illustrated embodiment, the attachment features 90 are hooks or latches that engage with corresponding hooks, latches, or bars of the moveable frame. This allows the consumer to move the modular container 10 onto the dolly, attach the modular container 10 to the dolly via engagement with the attachment features 90 and then move the modular container 10 by wheeling the dolly.

Figure 7:
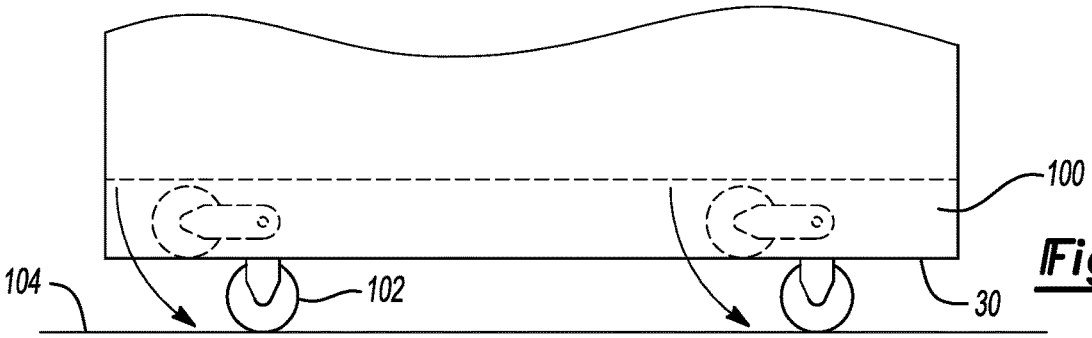
FIG. 7 is a schematic view of the underside of the modular container illustrating retractable wheels that can extend from the underside, according to one embodiment.

FIG. 7 illustrates an embodiment in which the modular container 10 is provided with retractable wheels. For example, the modular container 10 may include one or more pockets 100 (e.g., grooves, rails, etc.) in the bottom wall 30. The pockets 100 are sized to receive one or more wheels 102 when the wheels are retracted into the pockets 100. The wheels 102 can rotate relative to the modular container 10, such that they can rotate between a retracted position (shown in broken lines) and an extended position (shown in solid lines). The wheels 102 may be biased in one direction. For example, the wheels 102 may be spring-biased to be in the extended position to roll along an underlying surface 104. When the consumer picks up the modular container 10 and assembles the modular container 10 into the larger refrigerator 12, for example, surrounding structure within the larger refrigerator 12 may force the wheels 102 to rotate into their retracted position within the pockets 100. Thereafter, when the consumer removes the modular container 10 from the larger refrigerator 12, the wheels 102 can automatically extend to their extended position, allowing the modular container to roll on the underlying surface 104. In another embodiment, the modular container 10 is provided with an expandable handle (similar to a luggage bag) for ease of transport.

Figure 8:
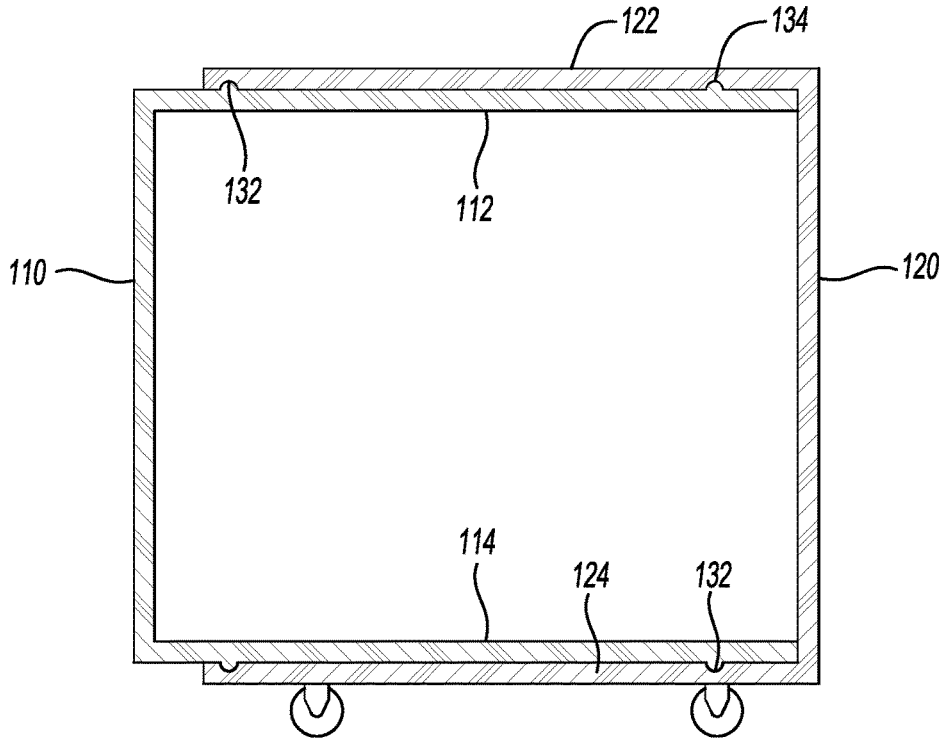
FIG. 8 is a cross-sectional schematic view of the modular container according to an embodiment in which the modular container is expandable, this view showing the modular container in a contracted position.
Figure 9:
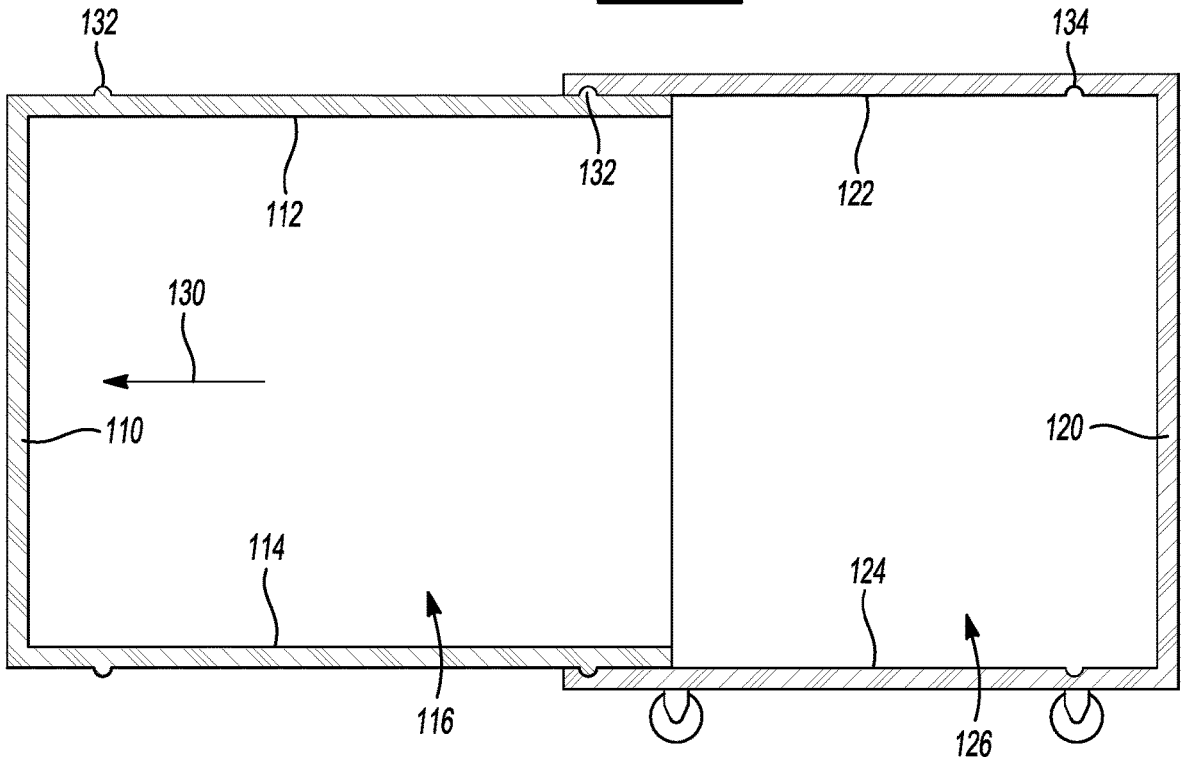
FIG. 9 is a cross-sectional schematic view of the modular container according to an embodiment in which the modular container is expandable, this view showing the modular container in an expanded position with a larger interior volume.

FIGS. 8-9 illustrate an embodiment in which the modular container 10 has an expandable interior volume. For example, the modular container 10 may have a first wall 110 (e.g., first side wall) and a second wall 120 (e.g., second side wall). The first wall 110 is connected to a pair of opposing walls, such as a top wall 112 and a bottom wall 114. Likewise, the second wall 120 is connected to a pair of opposing walls, such as a top wall 122 and a bottom wall 124. The first wall 110, top wall 112 and bottom wall 114 can collectively define a first interior compartment having a first interior volume 116 of the modular container 10. The second wall 120, top wall 122, and bottom wall 124 can collectively define a second interior compartment having a second interior volume 126 of the modular container 10. The first and second interior volumes 116, 126 can be combined to define the overall interior volume of the modular container 10 in FIG. 8 when the modular container is in a compressed or collapsed orientation. The consumer can then slide the first wall 110 relative to the second wall 120 in the direction indicated by arrow 130. This creates an overall interior volume of the modular container 10 that combines interior volume 116 and 126.

The walls of the expandable-volume modular container may be held together with attachment features. For example, the top wall 112 and bottom wall 114 may be provided with protrusions or knobs 132. The top wall 122 and bottom wall 124 may be provided with corresponding depressions or receptacles 134 configured to receive at least one of the knobs 132 in both the compressed position (FIG. 8) and expanded position (FIG. 9).

In various embodiments, the modular container 10 may be provided with "smart-refrigerator" technology. For example, the modular container 10 can have weight sensors, contact sensors, cameras or other sensors which allow the consumers to know if groceries are running low. The consumer can also be notified if certain groceries are expiring soon. In addition, the grocery stores can know the amount left in specific compartments of the modular container 10, the stores can better understand their own demand and can modulate their own orders to accommodate for the consumer's needs. Other components can also be added to allow location tracking and notification such as GPS, or sensor systems for geofencing. In one example, one or more sensors on-board the modular container can communicate with location services and determine that the modular container has left the house; in response, a notification can be sent to the consumer as to the closest grocery store, suggestions on what groceries to buy, if the consumer leaves the house with the modular container, and provide sales notifications to the consumer. In another example, if the container is used for grocery delivery services, these additional sensor systems can also provide consumer with real-time monitoring of the container and the environment conditions the produce has been through while inside the container (e.g., temperature, humidity, etc.).

The teachings of the modular container explained above allow the following usage scenarios. In one example, a consumer can remove the modular container from the larger refrigerator, and take the modular container with him/her to a grocery store. At the grocery store, the consumer can fill the modular container with groceries, and bring the modular container home. During transit, the groceries remain cool due to the dedicated refrigeration system on-board the modular container. When home, the consumer can then insert the modular container into the larger refrigerator. Upon attachment, a switch or sensor on the modular container deactivates the dedicated refrigeration system of the modular container. The window on the side of the modular container can also be automatically opened during insertion into the larger refrigerator. The modular container is now a part of the larger refrigerator itself, receiving cool air from the larger refrigerator.

In another example, the consumer can slide the modular container into a pantry that has attachment features that mimic those of the larger refrigerator. This allows the consumer to slide the modular container into engagement with the panty to store non-refrigerated groceries, such as canned goods, bread, etc. The switch or sensor on the modular container can deactivate the dedicated refrigeration system of the modular container once inserted into the pantry.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A refrigerator comprising: an interior compartment having a first attachment feature; and a modular container having:

a second attachment feature configured to selectively attach and detach from the first attachment feature enabling the modular container to be selectively attached and detached from the interior compartment, a door configured to selectively enclose an interior of the modular container, a dedicated refrigeration system mounted on the modular container that includes at least one of the following: condenser coils, evaporator coils, or a battery, a plurality of walls that define a perimeter of an interior volume of the modular container, a first interior compartment partially defined by a first of the walls, and a second interior compartment partially defined by a second of the walls, wherein the first of the walls is slidable relative to the second of the walls to expand the perimeter of the interior volume of the modular container.

2. The refrigerator of claim 1, wherein the first attachment feature is a guide or rail, and the second attachment feature is a guide or rail enabling the module container to slide in and out of the refrigerator.

3. The refrigerator of claim 2, wherein the modular container includes a pair of opposing exterior side walls, and the second attachment feature includes a pair of rails, each rail extending from front to back along a respective one of the exterior side walls.

4. The refrigerator of claim 1, wherein the modular container includes a third attachment feature configured to enable the modular container to attach to a moveable frame.

5. The refrigerator of claim 4, wherein the third attachment feature includes a latch or a hook.

6. The refrigerator of claim 4, wherein the modular container includes wheels coupled thereto, wherein the wheels are positioned such that they can rotate along an underlying surface when the modular container is attached to the moveable frame.

7. The refrigerator of claim 1, further comprising the battery mounted to the modular container and configured to power the dedicated refrigeration system, and a battery charger within the refrigerator configured to automatically recharge the battery when the modular container is attached to the interior compartment.

8. The refrigerator of claim 7, further comprising a switch configured to:

enable the battery to power the dedicated refrigeration system in response to the modular container detaching from the interior compartment, and disable the battery from powering the dedicated refrigeration system in response to the modular container being attached to the interior compartment.

9. The refrigerator of claim 1, wherein the dedicated refrigeration system mounted on the modular container includes the condenser coils on an outside of the modular container.

10. The refrigerator of claim 1, wherein the modular container includes a first wall and a second wall, wherein the first wall is slidable away from the second wall to expand the interior volume of the modular container.

11. The refrigerator of claim 1, wherein the dedicated refrigeration system is powered by the battery mounted on the modular container.

12. The refrigerator of claim 1, wherein the first interior compartment is slideable relative to the second interior compartment to transition the modular container between a collapsed position and an expanded position, wherein the interior volume of the modular container is greater when the modular container is in the expanded position than when in the collapsed position.

13. The refrigerator of claim 12, wherein one of the plurality of walls includes a protrusion that engages a corresponding receptacle of the modular container when the modular container is in the expanded position.

* * * * *